US005792277A

United States Patent [19]

Shubkin et al.

[11] Patent Number: 5,792,277

[45] Date of Patent: Aug. 11, 1998

[54] N-PROPYL BROMIDE BASED CLEANING SOLVENT AND IONIC RESIDUE REMOVAL PROCESS

[75] Inventors: Ronald L. Shubkin; Eric W. Liimatta, both of Baton Rouge, La.

[73] Assignee: Albemarle Corporation, Richmond, Va.

[21] Appl. No.: 899,346

[22] Filed: Jul. 23, 1997

[51] Int. Cl.[6] ..... B08B 3/04

[52] U.S. Cl. ..... 134/19; 134/4; 134/22.14; 134/22.19; 134/25.1; 134/40; 510/177; 510/178; 510/408; 510/409; 510/411

[58] Field of Search ..... 134/19, 40, 22.14, 134/22.19, 25.1; 510/177, 178, 409, 410, 411, 408

[56] References Cited

U.S. PATENT DOCUMENTS

| | | | |
|---|---|---|---|
| 2,371,645 | 3/1945 | Aitchison et al. | 134/31 |
| 2,870,094 | 1/1959 | Cathcart | 252/171 |
| 3,730,904 | 5/1973 | Clementson et al. | 252/171 |
| 3,773,677 | 11/1973 | Boyles | 252/172 |
| 4,056,403 | 11/1977 | Cramer et al. | 134/22 R |
| 4,107,077 | 8/1978 | Sullivan, Jr. et al. | 252/408 |
| 4,652,389 | 3/1987 | Moll | 252/90 |
| 4,900,456 | 2/1990 | Ogilvy | 252/8.551 |
| 5,102,573 | 4/1992 | Han et al. | 252/153 |
| 5,190,678 | 3/1993 | Swartz et al. | 252/18 |
| 5,207,953 | 5/1993 | Thorssen et al. | 252/601 |
| 5,320,683 | 6/1994 | Samejima et al. | 134/40 |
| 5,403,507 | 4/1995 | Henry | 252/170 |
| 5,492,645 | 2/1996 | Oshima et al. | 252/171 |
| 5,616,549 | 4/1997 | Clark | 510/412 |
| 5,665,170 | 9/1997 | Lee et al. | 134/19 |
| 5,665,173 | 9/1997 | Lee | 134/40 |
| 5,669,985 | 9/1997 | Lee et al. | 134/40 |
| 5,690,862 | 11/1997 | Hoove, Jr. et al. | 252/364 |
| 5,707,954 | 1/1998 | Lee | 510/412 |

FOREIGN PATENT DOCUMENTS

| | | |
|---|---|---|
| 0609004 | 8/1994 | European Pat. Off. . |
| 4161234 | 6/1992 | Japan . |
| 6128591 | 5/1994 | Japan . |
| 7150197 | 6/1995 | Japan . |

OTHER PUBLICATIONS

T. Tisch, "Cleaning Solutions for a Clean Environment: Developments in Motion-Picture Film-Cleaning Technology," *8012 SMPTE Journal*, 104:528–533, Aug. 1995.

K.W. Suh et al., "Phase Equilibria in Polymer-Liquid-Liquid System," *J. Polymer Science Part A-2*, vol. 6, 813–823 (1968).

Abstract—Great Britain Patent No. 1276783-A, published Jun. 7, 1972, assigned to Imperial Chemical Inds Lt, entitled "Stabilised trichloroethane-contg nitromethane and heterocyclic nitrogen cpds".

Kirk-Othmer Encyclopedia Of Chemical Technology, "Blood, Coagulants and Anticoagulants to Cardiovascular Agents," Third Edition, vol. 4, (1978), John Wiley & Sons, Inc., New York, pp. 256, 257, 262.

NFPA 325—National Fire Protection Association, Inc., *Guide to Fire Hazard Properties of Flammable Liquids, Gases, and Volatile Solids*, 1994 Edition, prepared by the Technical Committee on Classification and Properties of Hazardous Chemical Data, pp. 325-1–325-94.

Dipsol Chemicals Co., Ltd., Product Brochure entitled "Dipsol SC-52A-Cleaning Agent Substitute for Freon and Chlorine Solvents," date unknown, pp. 1–13 (w/translation-pp. 1–7).

Abstract—Japanese Patent Publication No. 0729393, published Nov. 7, 1995, applicant—Senju Meal Ind Co Ltd, entitled "Cleaning Agent".

Abstract—Japanese Patent Publication No. 07310097-A, published Nov. 28, 1995, assigned to Mitsubishi Jukogyo KK, entitled "High detergent power cleaner for dry cleaning-contg. mixt. of petroleum based solvent and bromine-contg. solvent".

Abstract—Japanese Patent Publication No. 08067643-A, published Mar. 12, 1996, assigned to Toa Gosei Chem Ind Ltd, entitled "Bromo-propane compositions—useful as detergining solvents, stabilised by ether compounds, epoxy compounds, and nitro compounds".

Abstract—Japanese Patent Publication No. 03173835-A, published Jul. 29, 1991, assigned to Asahi Glass, entitled "New Stabilising (pseudo) azeotropic tri: cloro; di; fluoroethane compsn.—useful as substitute freon and for heat transfer medium, foaming agent and precision instrument parts".

Abstract—Japanese Patent Publication No. 0317633-A, published Jul. 31, 1991, assigned to Asahi Glass Co Ltd, entitled "Azeotropic and azeotrope-like compsns.—comprises tri; chloro; di; fluoroethane and 1-bromo-propane and/or 2-bromo-propane".

Abstract—Japanese Patent Publication No. 07150196-A, published Jun. 13, 1995, assigned to Dipsol KK, entitled "Compsn. replacing freon(s) and chlorine-type solvents—comprises bromo: Hydrocarbon and opt. Nitroalkane, ether, epoxide and/or amine stabilisers, has high degreasing power without corrosion".

*Primary Examiner*—Jill Warden
*Assistant Examiner*—Sharidan Carrillo
*Attorney, Agent, or Firm*—E. E. Spielman, Jr.

[57] ABSTRACT

Stabilized, n-propyl bromide containing cleaning solvent compositions and a cleaning process are provided. The cleaning solvent compositions include an alcohol selected from 1-propanol and 2-butanol, including mixtures thereof, as a co-solvent so as to form azeotropic or azeotropic-like mixtures which have no fire or flash points.

16 Claims, No Drawings

N-PROPYL BROMIDE BASED CLEANING SOLVENT AND IONIC RESIDUE REMOVAL PROCESS

TECHNICAL FIELD

This invention relates generally to n-propyl bromide-based solvent compositions and, more particularly, to azeotropic or azeotropic-like, stabilized n-propyl bromide solvent compositions which include 1-propanol and/or 2-butanol as a co-solvent and their use in the removal of ionic contaminants from articles such as electronic components.

BACKGROUND n-Propyl bromide is recognized as being an environmentally friendly solvent for cold and vapor degreasing processes. Because n-propyl bromide may be reactive to metals and its electrolysis products may be corrosive toward metals, especially when used in vapor degreasing processes, n-propyl bromide-based cleaning solvent compositions usually include one or more stabilizers such as nitroalkanes, ethers, amines, and/or epoxides (see, for example, U.S. Pat. Nos. 5,492,645 and 5,616,549). In order to reduce costs, the use of various co-solvents, including methanol, ethanol, and isopropanol have been suggested (see allowed U.S. application Ser. No.08/551,641, filed Nov. 1, 1995 now U.S. Pat. No. 5,690,862). One potential use of such cleaning solvent compositions is the removal of ionic residues from electronic components such as printed circuit boards. These residues, which result from soldering and fluxing processes, if not reduced to very low levels, e.g., <10–14 micrograms/sq. in., can cause electrical failures. The components are generally cleaned using a vapor degreaser apparatus in which the component is placed in a vapor layer above the boiling solvent, such that the solvent condenses on the component and rinses away the residues. For safety reasons, the solvent composition should not have a flash or fire point. Also, the solvent composition should be an azeotropic or azeotropic-like mixture, such that the composition of the solvent in the vapor space, boil-up sump and rinse sump sections of the degreaser system will remain substantially constant during continuous operation.

It would be desirable to use a co-solvent with the n-propyl bromide which would provide a cleaning solvent composition that satisfies the above criteria, while enhancing the removal of ionic contaminants from electronic components. Although lower alcohols such as methanol, ethanol and isopropanol will form azeotropic or azeotropic-like mixtures with n-propyl bromide, these mixtures have flash and/or fire points. We have now found that 1-propanol and 2-butanol, when used in certain proportions in combination with n-propyl bromide and a stabilizer system, form azeotropic or azeotropic-like cleaning solvent compositions which, surprisingly, have no fire or flash point and which also function to remove ionic contaminants in a superior manner.

SUMMARY OF THE INVENTION

In accordance with this invention, there is provided a solvent composition comprised of:

(a) from about 84 to about 94 wt. % n-propyl bromide, (b) from about 5 to about 10 wt. % of alcohol selected from the group consisting of 1-propanol and 2-butanol, including mixtures thereof, and (c) from about 1 to about 6 wt. % of a stabilizer system for said n-propyl bromide, said solvent composition being either azeotropic or azeotropic-like.

Also provided is a process for cleaning an article, said process comprising the steps of, (i) boiling a solvent composition so as to form a vapor layer, said solvent composition being comprised of:

(a) from about 84 to about 94 wt. % n-propyl bromide, (b) from about 5 to about 10 wt. % of alcohol selected from the group consisting of 1-propanol and 2-butanol, including mixtures thereof, and (c) from about 1 to about 6 wt. % of a stabilizer system for said n-propyl bromide, said solvent composition being either azeotropic or azeotropic-like, and (ii) placing the article in the vapor layer, such that said vapor layer condenses on the article and flushes away contaminants from the article.

DESCRIPTION OF THE PREFERRED EMBODIMENTS

The n-propyl bromide for use in the compositions of the invention should be at least about 98% pure and, preferably, the n-propyl bromide is supplied to the composition as 99+wt. % n-propyl bromide, with the most common impurity being isopropyl bromide. The weight percentages which are recited in this paragraph are based on the total weight of n-propyl bromide and impurities. The isopropyl bromide impurity is naturally found in the raw n-propyl bromide product, but its presence can be attenuated by distillation. It is not a benign impurity as it is very much less stable than n-propyl bromide and, thus, can result in aggressive corrosion. For vapor degreasing and cleaning, the isopropyl bromide content should be kept low—for example, within the range of from about 0.01 to about 0.5 wt. %. n-Propyl bromide can be purchased commercially from Albemarle Corporation, Richmond, Va.

The alcohol co-solvent for the composition is selected from 1-propanol and 2-butanol, including mixtures thereof. These alcohols give enhanced removal of ionic impurities, such that an ionic cleanliness of printed circuit boards, as measured by the resistivity of solvent extract (ROSE) test method, of less than about 3 micrograms/sq. in. can be achieved by vapor degreasing. At the same time, we have found that these alcohols, when used in amounts of from about 5 to about 10 wt. %, based on the total weight of cleaning composition, in combination with from about 84 to about 94 wt. % of n-propyl bromide, based on the total weight of cleaning composition, provide a cleaning composition mixture which is azeotropic or azeotropic-like. By azeotropic-like is meant that the mixture may not be a true azeotropic solution, but it will distill without any substantial change in composition over an extended period of time ( i.e., at least 22 hours). This is important because it permits the cleaning composition to be continuously recycled (such as in a vapor degreaser) without any significant dilution or concentration of any of the components.

Another important feature of this invention is that the stabilized n-propyl bromide/alcohol compositions have no flash or fire point by the standard Tag Open Cup (ASTM D-1310) or Tag Closed Cup (ASTM D-56) methods, despite the presence of the alcohol. This is not true for azeotropic or azeotropic-like combinations of n-propyl bromide with other low molecular weight alcohols such as methanol, ethanol and isopropanol. For example, isopropanol, when used in an amount of 15 wt. % so as to provide an azeotropic-like mixture, gives a composition which sustains burning at 32° C. For safety reasons, it is important in many applications that the solvent compositions used for cleaning have no flash point and cannot sustain burning up to the boiling point of the mixture.

The compositions of the invention also include a stabilizer system for the n-propyl bromide because metals such as aluminum, magnesium and titanium can catalyze the dehydrohalogenation of the n-propyl bromide to produce corrosive materials such as HBr. Accordingly, the cleaning compositions should include from about 1 to about 6 wt. %, based on the total weight of composition, of one or more stabilizer compounds such as metal pacifiers and acid acceptors. Non-limiting examples of suitable types of compounds for stabilizing the n-propyl bromide include ethers, epoxides, nitroalkanes and amines.

Non-limiting examples of suitable ethers include 1,2-dimethoxyethane, 1,4-dioxane, 1,3-dioxolane, diethyl ether, diisopropyl ether, dibutyl ether, trioxane, alkyl cellosolves in which the alkyl group has 1 to 10 carbon atoms such as methyl cellosolve, ethyl cellosolve and isopropyl cellosolve, dimethyl acetal, γ-butyrolactone, methyl t-butyl ether, tetrahydrofuran and N-methylpyrrole. They are usable either singularly or in the form of a mixture of two or more of them. 1,3-dioxolane is preferred.

Non-limiting examples of suitable epoxides include epichlorohydrin, propylene oxide, butylene oxide, cyclohexene oxide, glycidyl methyl ether, glycidyl methacrylate, pentene oxide, cyclopentene oxide and cyclohexene oxide. They are usable either singularly or in the form of a mixture of two or more of them. 1,2-butylene oxide is preferred.

Non-limiting examples of nitroalkanes usable in the present invention include nitromethane, nitroethane, 1-nitropropane, 2-nitropropane and nitrobenzene. They are usable either singularly or in the form of a mixture of two or more of them. Nitromethane is preferred.

Non-limiting examples of suitable amines include hexylamine, octylamine, 2-ethylhexylamine, dodecylaamine, ethylbutylamine, hexylmethylamine, butyloctylamine, dibutylamine, octadecylmethylaine, triethylamine, tributylamine, diethyloctylamine, tetradecyldimethylamine, diisobutylamine, diisopropylamine, pentylaamine, N-methylmorpholine, isopropylamine, cyclohexylamine, butylamine, isobutylamine, dipropylamine, 2,2,2,6-tetramethylpiperidine, N,N-di-allyl-p-phenylenediamine, diallylamine, aniline, ethylenediamine, propylenediamine, diethylenetriamine, tetraethylenepentane, benzylamine, dibenzylamine, diphenylamine and diethylhydroxyamine. They are usable either singularly or in the form of a mixture of two or more of them.

When present, preferred amounts of each type of stabilizer compound include from about 0.05 to about 1.0 wt. % epoxide, from about 2.0 to about 4.0 wt. % ether, from about 0.05 to about 1.0 wt % nitroalane and from about 0.05 to about 1.0 wt. % amine, with each of the above percentages being based on the total weight of cleaning composition.

The solvent compositions of this invention are suitable for use in cold cleaning applications, but are especially useful in the vapor cleaning of electronic components, such as circuit boards, using a vapor degreaser. Cold cleaning is usually characterized by the immersion of the article to be cleaned in the solvent composition at a temperature which is within the range of from about room temperature to about 55° C. Vapor cleaning is characterized by passing the article to be cleaned through a vapor of the solvent composition, with the article at a temperature which causes condensation of the vapor on its surfaces. The condensate effects its cleaning function and then drips off. The vapor temperatures are generally approximate to the boiling point of the solvent composition, which in the instant case will be around 68° to 73° C. depending upon the particular quantitative and qualitative identity of the solvent composition being used.

A typical vapor degreaser system has a boil-up sump which contains the cleaning solvent composition and an adjacent rinse sump which collects the condensed solvent vapor. The solvent in the rinse sump overflows back into the boil-up sump. Solvent vapor fills the chamber above the two sumps. The hot vapors condense onto the part to be cleaned. Optionally, a spray wand is used to place additional hot solvent onto the part when the part has reached the vapor temperature. Besides placing the part into the vapor, it can also be immersed into the boil-up sump and/or the rinse sump to further enhance cleaning. In addition, the rinse sump may also be equipped with an ultrasonic agitator which further enhances the cleaning efficiency. As discussed above, in order to maintain a consistent composition in each part of the vapor degreaser system, the cleaning solvent composition should be azeotropic or azeotropic-like. The compositions of the invention are stable in this respect when tested in a continuous distillation apparatus. In this apparatus, the distillate is collected in a receiver which overflows into the distillation pot so as to simulate continuous operation in a vapor degreaser system. After running the apparatus for 22 hours with a cleaning solvent of this invention, the composition of the solvent in the distillation pot and receiver were determined in wt. % by gas chromatography (GC). The results are given in Table I.

TABLE I

| Ingredient | Start Wt. % | Pot Wt. % | Receiver Wt. % |
|---|---|---|---|
| n-propyl-bromide | 88.72 | 87.91 | 89.85 |
| 1-propanol | 7.47 | 8.06 | 6.52 |
| 1,3-dioxolane | 2.50 | 2.56 | 2.40 |
| 1,2-epoxybutane | 0.51 | 0.48 | 0.52 |
| nitromethane | 0.49 | 0.48 | 0.49 |
| unknowns | 0.30 | 0.52 | 0.23 |

It can be seen from the results reported in Table I, that the cleaning composition was stable. The proportions remained very similar in the pot and receiver even after 22 hours of continuous distillation. A formulation which contains the same proportions of stabilizers along with 5.0 wt. % of 2-butanol and 91.5 wt. % n-propyl bromide is, likewise, azeotropic in nature and has no flash point.

The following illustrates the efficacious nature of a solvent composition and process of this invention. It is not intended for the Examples to be taken, in any way, as limiting the scope of the inventions described herein.

EXAMPLE I

Freshly prepared circuit boards, (6"×7") polyimide with a solder mask on both sides, were cleaned in a vapor degreaser equipped with a spray wand having a 15-gallon capacity. Each circuit board contained twelve 20-pin LCCS (Leadless Chip Carrier) and two 68-pin LCCS. The LCCS had 50 mil pitch centers (distance between leads). The boards had been subjected to a normal solder flux and reflow manufacturing operation. The cleaning solvent had a composition in weight percent of about 89.0% n-propyl bromide, 7.5% 1-propanol, 2.5% 1,3-dioxolane, 0.5% 1,2-epoxybutane, and 0.5% nitromethane. This composition has no flash or fire points by the Tag Open Cup or Tag Closed Cup methods. The process cycle was:

| | | |
|---|---|---|
| 1. | Vapor dwell | 57 seconds |
| 2. | Pre-clean spraying in air | 30 seconds |
| 3. | Immersion in boiling solvent | 100 seconds |
| 4. | Recirculating distillate spray | 27 seconds |
| 5. | Vapor dwell | 57 seconds |

The spray wand pressure was 45 psig and the spray was also used when the part was immersed in the boiling solvent. Three boards were cleaned. Each board was examined under a microscope after cleaning and then the remaining ionic residues were measured using an Alpha Metals Omega Meter, model 60D SMD. The microscopic examination showed only minute traces of residue remaining.

The Omega Meter readings were made while the parts were washed in a 75 vol. % isopropyl alcohol (IPA)/ 25 vol. % deionized water solution for ten minutes. The Omega Meter continuously reads the resistivity of the solution and calculates the micrograms of ionics (as NaCl) removed per square inch of the board surface (front and back). The data reported below are the final readings in micrograms/sq. in. after ten minutes of washing.

| Board No. | Ionic Contamination |
|---|---|
| 1 | 4.4μgms/in$^2$ |
| 2 | 3.9 |
| 3 | 6.4 |
| Ave. | 4.9μgms/in$^2$ |

The results are well within the maximum 14 micrograms/sq. in. military specifications (MIL-C-28809 and MIL-STD-2000) and even exceed the stricter NASA requirement of a maximum ionic concentration of 10 micrograms/sq. in.

EXAMPLE II

Circuit boards were precleaned to ionic levels of under 1.0 micrograms of sodium chloride. The boards had two leadless chip carriers soldered in place. Alpha Metals RA 321 RA solder paste was hand applied to a number of test pads and was reflowed in a forced air oven. After the boards had cooled, the boards were sprayed with a liberal amount of Kesler 1585-MIL RA flux. The fluxed boards were again exposed to reflow temperatures in the forced air oven. These processed boards would be expected to have higher levels of flux residue than found in a normal manufacturing operation (worst case). The boards were placed in a degreaser basket which was slowly lowered into the vapor zone of a vapor degreaser and then into the boiling sump. The cleaning solvent had the same composition as that used in Example I. The sump immersion was for three minutes. The basket was slowly transferred to the rinse sump and held there for one minute. The basket was removed to the vapor zone until the parts were dry and then was removed from the vapor degreaser. The cleaned boards were analyzed for ionic contaminants by the resistivity of solvent extract (ROSE) test and by ion chromatography.

The ROSE test was accomplished using an Omega Meter 600SC. The test samples were tested according to IPC-TM-650, method 2.3.26.1, using a 10 minute test time, full immersion, and a solution concentration of 75% isopropanol/25% by volume deionized water. The surface area used for computation was 35.0 square inches. The data is reported below, in which the units are expressed as the total micrograms of NaCl equivalence per square inch of extracted surface.

| Sample | Ionic Contamination |
|---|---|
| 1 | 2.30μgms/in$^2$ |
| 2 | 3.10 |
| 3 | 2.70 |
| Ave. | 2.70μgms/in$^2$ |

The results, as in Example I, show contamination levels which are well below the military and NASA specifications, even in a "worst case" situation and were judged as better than the Freon TMS benchmark. The contamination levels were also only about 60% of the levels found when similar board samples were cleaned with a stabilized n-propyl bromide cleaning formulation which did not include any alcohol.

According to the ion chromatography test procedure, each test board was placed into a clean Kapak (heat sealable polyester film) bag. A volume sufficient to immerse the test sample of a isopropanol (75%) and deionized water (25%) by volume mixture was placed into each bag. The bags contained a vent hole. Each bag and sample was placed into an 80° C. water bath for one hour. After one hour, the bags were removed from the water bath and the test samples were removed from the bags and allowed to air dry. A 3 mL sample of each extract solution was analyzed using a Dionex ion chromatography system and a sodium borate solvent. The ion chromatography data is reported below, in which the data is shown as micrograms of the residue species per square inch of extracted surface. This measure is different from the micrograms of sodium chloride per square inch which is the common measure for most ionic cleanliness test instruments.

| Sample | Chloride |
|---|---|
| 4 | 2.87 |
| 5 | 2.18 |
| 6 | 2.60 |
| Avg. | 2.55 |

The amount of chloride anion detected was only about 75% of that which remained on similar samples which were cleaned using the formulation which did not include the alcohol.

What is claimed is:

1. A solvent system comprised of:

(a) from about 84 to about 94 wt. % n-propyl bromide, (b) from about 5 to about 10 wt. % of alcohol selected from the group consisting of 1-propanol and 2-butanol, including mixtures thereof, and (c) from about 1 to about 6 wt. % of a stabilizer system for said n-propyl bromide, said solvent composition being azeotropic.

2. The solvent composition according to claim 1 wherein said stabilizer system comprises from about 0.05 to 1.0 wt. % of an epoxide and from about 2 to 4 wt. % of an ether.

3. The solvent composition according to claim 2 wherein said stabilizer system also includes from about 0.05 to about 1.0 wt. % of a nitroalkane.

4. The solvent composition according to claim 3 wherein said nitroalkane is nitromethane, said ether is dioxolane, and said epoxide is 1,2-epoxybutane.

5. The solvent composition according to claim 1 wherein said alcohol is 1-propanol.

6. The solvent composition according to claim 1 wherein said alcohol is 2-butanol.

7. The solvent composition according to claim 4 wherein said alcohol is 1-propanol.

8. The solvent composition according to claim 4 wherein said alcohol is 2-butanol.

9. A process for cleaning an article, said process comprising the steps of (i) boiling a solvent composition so as to form a vapor layer, said solvent composition being comprised of:

(a) from about 84 to about 94 wt. % n-propyl bromide, (b) from about 5 to about 10 wt. % of alcohol selected from the group consisting of 1-propanol and 2-butanol, including mixtures thereof, and (c) from about 1 to about 6 wt. % of a stabilizer system for said n-propyl bromide, said solvent composition being either azeotropic or azeotropic-like, and (ii) placing the article in the vapor layer, such that said vapor layer condenses on the article and flushes away ionic contaminants from the article.

10. The process according to claim 9 wherein said alcohol is 1-propanol.

11. The process according to claim 9 wherein said alcohol is 2-butanol.

12. The process according to claim 9 wherein said stabilizer system comprises from about 0.05 to 1.0 wt. % of an epoxide and from about 2 to 4 wt. % of an ether.

13. The process according to claim 12 wherein said stabilizer system also includes from about 0.05 to about 1.0 wt. % of a nitroalkane.

14. The process according to claim 9 wherein said article is cleaned in a vapor degreaser system.

15. The process according to claim 14 wherein said article is an electronic component and the ionic contamination is reduced to less than about 10 micrograms/in$^2$.

16. The process according to claim 9 wherein said article is a printed circuit board.

* * * * *